United States Patent [19]

Poehlmann

[11] 4,233,737

[45] Nov. 18, 1980

[54] KNIFE WITH REMOVABLE BLADE

[76] Inventor: Paul W. Poehlmann, P.O. Box 445, Stinson Beach, Calif. 94970

[21] Appl. No.: 29,847

[22] Filed: Apr. 13, 1979

Related U.S. Application Data

[63] Continuation of Ser. No. 873,506, Jan. 30, 1978, abandoned.

[51] Int. Cl.[3] ..... B26B 1/00

[52] U.S. Cl. ..... 30/335; 30/161; 30/342; 30/344

[58] Field of Search ..... 30/335, 342, 157, 156, 30/161

[56] References Cited

U.S. PATENT DOCUMENTS

| | | | |
|---|---|---|---|
| 98,949 | 1/1870 | Gerelds | 30/161 |
| 3,783,509 | 1/1974 | Lake | 30/161 |
| 3,900,950 | 8/1975 | Collins | 30/342 |
| 3,974,868 | 8/1976 | Derbyshire | 30/335 |
| 4,062,118 | 12/1977 | Modafferi | 30/344 |

FOREIGN PATENT DOCUMENTS

| | | | |
|---|---|---|---|
| 2208782 | 8/1973 | Fed. Rep. of Germany | 30/335 |
| 740133 | 11/1955 | United Kingdom | 30/161 |

*Primary Examiner*—Othell M. Simpson

*Assistant Examiner*—J. T. Zatarga

*Attorney, Agent, or Firm*—Lothrop & West

[57] ABSTRACT

A hand knife has a removable blade. Side plates are spaced apart on opposite sides of a main frame having a rectangular socket in one end thereof. One side plate has a non-circular aperture therein and the other side plate has a circular opening therein. A pin is movable on a transverse axis relative to the main frame and has a non-circular portion in the aperture and a circular portion in the opening. A blade has an exteriorly rectangular end slidable in a predetermined direction to fit the socket. The end interiorly has a keyhole opening, the circular portion of which fits the larger, circular part of the pin and the rectangular portion of which is open ended in the predetermined direction and fits the smaller, non-circular portion of the pin. A spring normally urges the circular portions into interengagement. A button on the pin, when pressed, overcomes the spring and moves the non-circular portion into sliding engagement with the rectangular portion of the keyhole opening. The blade can then be moved in the predetermined direction relative to the main frame. In another form, a springy lever on the main frame is movable out of engagement with a notch in the blade to release the blade for rotation about the pin to a position in which the lever indexes against the socket end of the blade.

4 Claims, 19 Drawing Figures

FIG-10
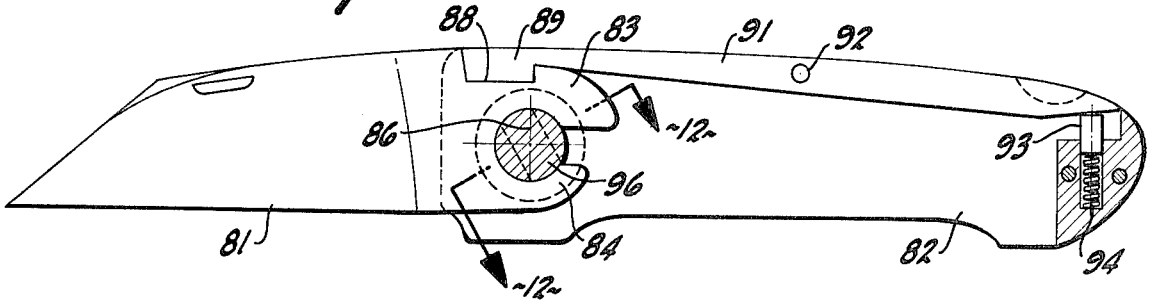
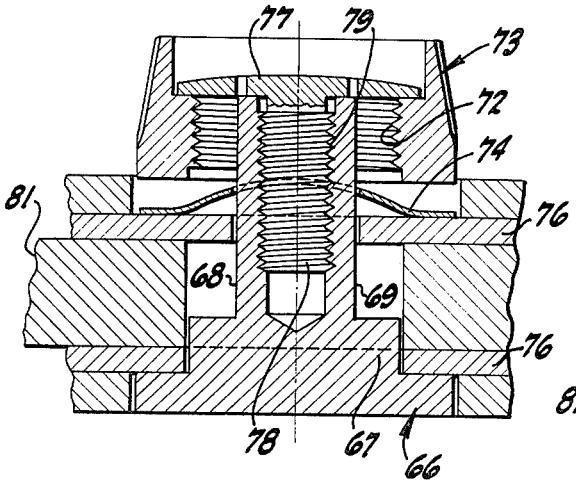
FIG-12
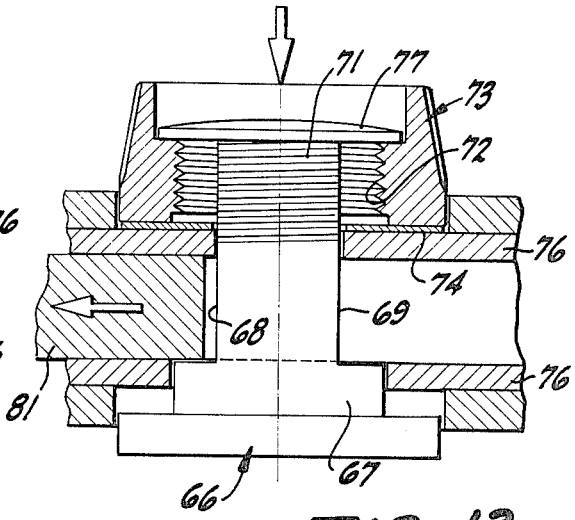
FIG-13
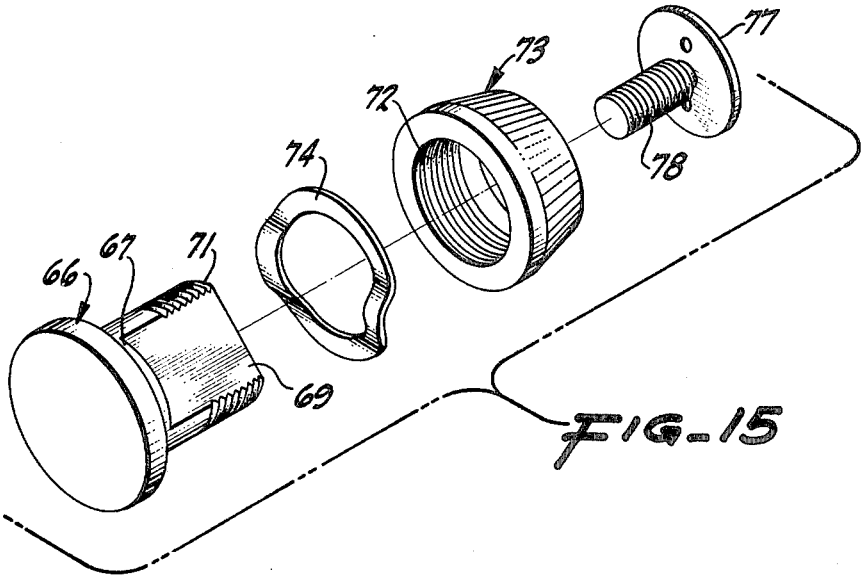
FIG-15

FIG-17
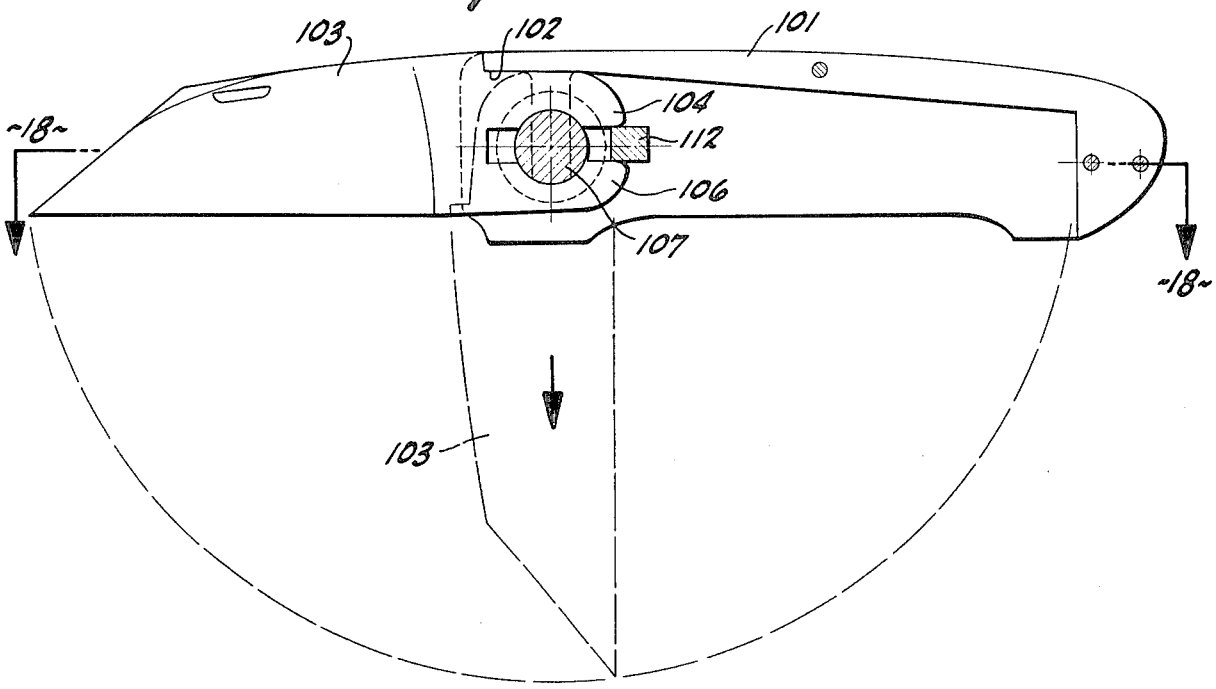
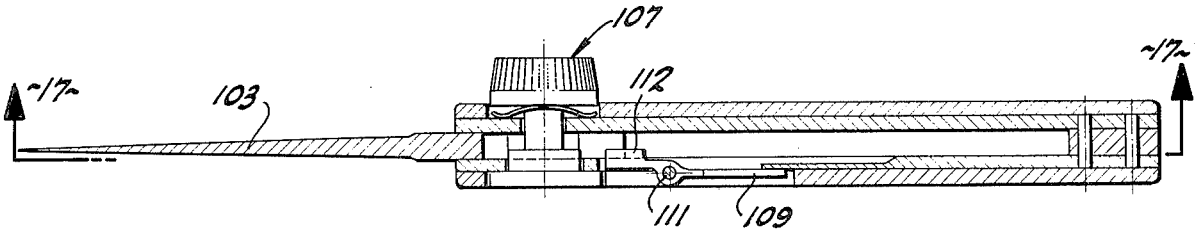
FIG-18
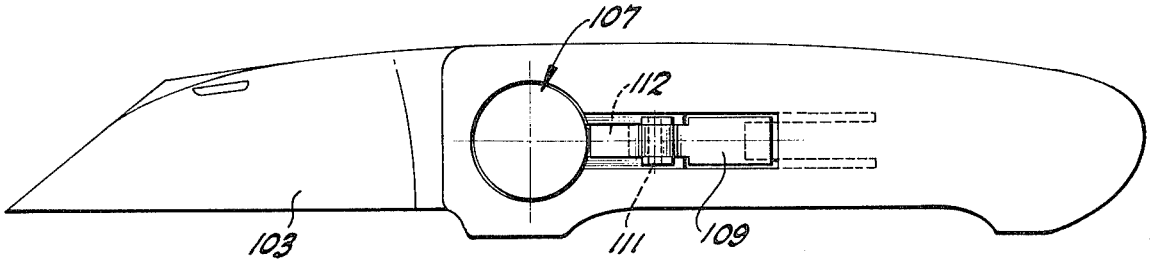
FIG-19

KNIFE WITH REMOVABLE BLADE

This is a continuation of application Ser. No. 873,506, filed Jan. 30, 1978, now abandoned.

CROSS-REFERENCES TO RELATED APPLICATIONS, IF ANY

While no related applications are known, U.S. Pat. No. 3,942,249 issued Mar. 9, 1976 to the present inventor for a Knife. That patent is also the closest prior art known.

BRIEF SUMMARY OF THE INVENTION

For personal or hand knives somewhat larger than pocket size, it is often convenient to have a permanent handle usable with a number of different knife blades or even other implements. There is a need for a firm connection between the blade and the handle when they are together and also for an easy and quick release, all designed to maintain high security, to avoid possible injury and to supply a great variety of arrangements. That is done herein by a main frame mechanism receptive to the cooperating portions of any one of several different blades or implements and effective to hold the blade or implements firmly and cleanly in place, although releasing them upon appropriate operation of a retainer. There are auxiliary mechanisms such as an indexing device and variant forms of releasing mechanisms.

BRIEF DESCRIPTION OF THE SEVERAL VIEWS OF THE DRAWING

FIG. 10 is a cross-section of a modified form of knife having a rotatable blade.

FIG. 12 is a view in cross-section on the line 12—12 of FIG. 10 showing a modified form of pin structure in normal position.

FIG. 13 is a cross-section, like FIG. 12, showing the pin structure in a releasing position.

FIG. 15 is an isometric, exploded view showing the pin structure of FIGS. 12, 13 and 14.

FIG. 17 is a cross-section like FIG. 10 of a further modified form of knife, the plane of section being on the line 17—17 of FIG. 18.

FIG. 18 is a cross-section on the line 18—18 of FIG. 17.

FIG. 19 is a side elevation of the knife shown in FIGS. 17 and 18.

DETAILED DESCRIPTION

Figures 1, 2, 3, 4, 5:
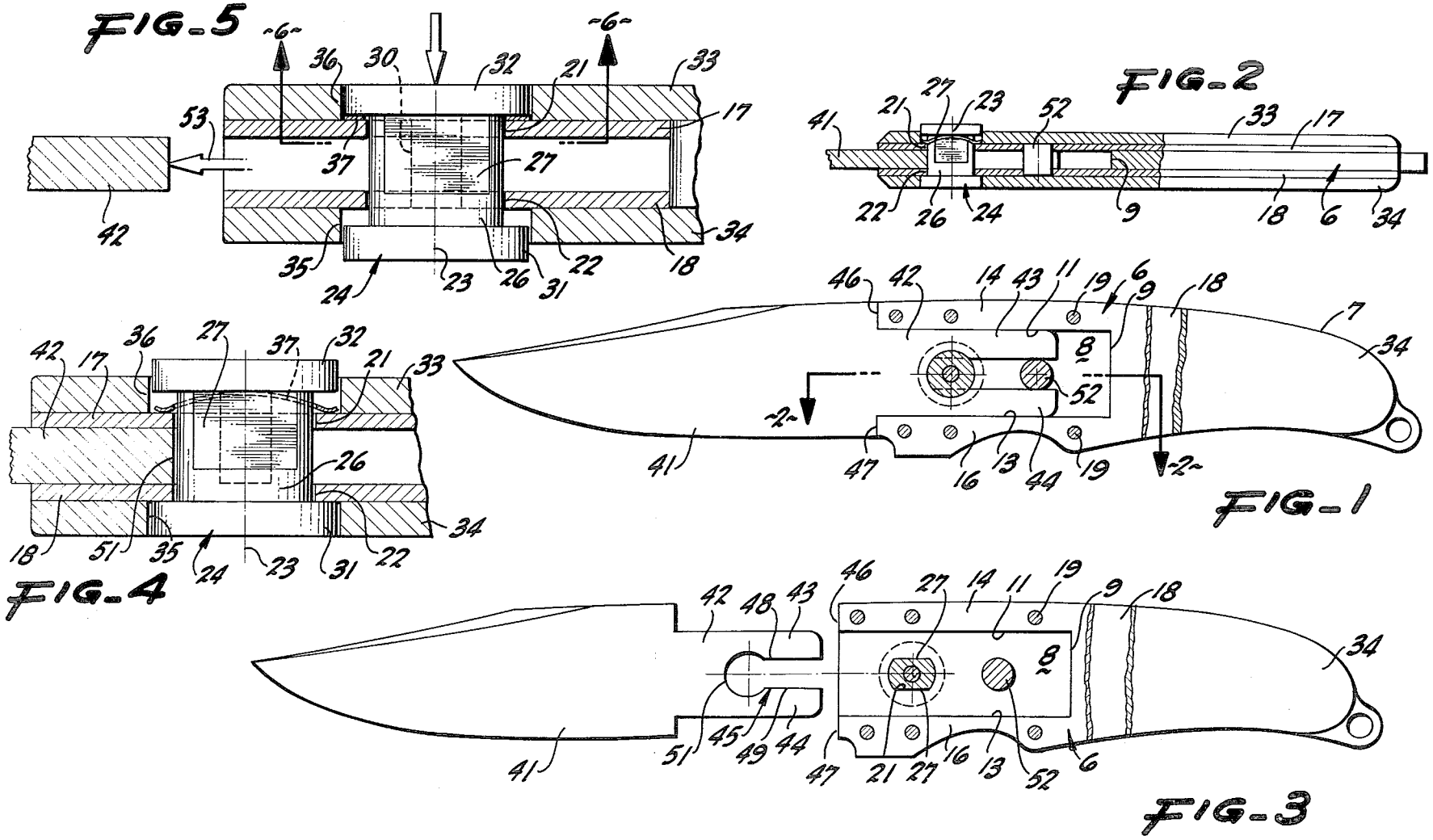
FIG. 1 is a side elevation, with various portions broken away, showing a knife with removable blade pursuant to the invention, some portions being disclosed in cross-section.
FIG. 2 is in part a plan and in part a cross-section, with portions broken away, of the knife of FIG. 1, the section being taken along the line 2—2 of FIG. 1.
FIG. 3 is a view comparable to FIG. 1 but of a modified form of knife and with the blade and the main frame disassembled.
FIG. 4 is an enlarged detail of the pin structure shown in FIG. 2, the pin being in normal position.
FIG. 5 is a view comparable to FIG. 4, showing the pin in a displaced position.

One successful form of the present knife with removable blade is particularly disclosed in FIGS. 1 through 7. A handle assembly includes a central main frame plate 6, usually of stiff metal, has one portion with an envelope contour 7 suitable for holding in the hand. Another portion is provided with an open ended, rectangular socket 8 defined by an end wall 9 and side walls 11 and 13 extending in a predetermined direction. The frame portions alongside the cutout 8 constitute ledges 14 and 16.

Disposed on either side of the main frame plate 6 are side plates 17 and 18 of comparable material and secured to the main frame plate in any appropriate way; for example, by rivets 19. The plates 17 and 18 are nearly identical and have approximately the outline contour of the main frame plate, but the plate 17 is pierced by an aperture 21 (FIG. 6) of non-circular configuration. The configuration is that of a portion of a circle with two parallel chords extending thereacross in the predetermined direction and so is non-circular. The plate 18 is similarly pierced with an opening 22, but this opening is circular.

Designed to be movable with respect to the main frame plate along a transverse axis 23, normal to the predetermined direction, is a pin 24. In one portion 26, as especially shown in FIGS. 4 and 5, the pin is circular-cylindrical of a size slightly smaller than the opening 22. The diametrical dimension of the portion 26 measured in a plane normal to the axis 23 is of a predetermined value. The pin also has a non-circular portion 27 having a minor dimension in a plane normal to the axis of something less than the dimensional value of the circular portion. The shape of the portion 27 is similar to but slightly smaller than that of the opening 21. With this arrangement, the pin can be moved axially within the aperture 21 and the opening 22 and is thus movable transversely along the axis 23 with respect to the main frame plate.

In order to control the pin appropriately, it is provided with a head 31 on one side and a similar head 32 on the other side. The head 32 is preferably provided with screw threads 30 engaging comparable threads in the body of the pin so that the parts can be readily assembled and disassembled as required.

The outside of the plates 17 and 18 is preferably finished by covers 33 and 34 secured thereto by any convenient means. The covers are formed with recesses 35 and 36 to receive the heads 31 and 32. Preferably, the dimensions are such that in one position of the pin one of the heads is flush with its cover whereas the other head projects slightly beyond its cover.

The pin 24 can readily be moved manually. Normally, the pin is urged into one extreme position by means of a spring 37. This is a rippled washer disposed between the side plate 17 and the head 32 and normally urges the pin into a position so that at least a part of the completely circular portion 26 is disposed in the socket 8 between the facing interior surfaces of the side plates 17 and 18, as shown in FIG. 4.

Designed to cooperate with the structure as so far described, is a knife blade 41 of any chosen general configuration but particularly having a tang 42 with a central portion defined by a pair of tines 43 and 44 having parallel sides extending in the predetermined direction and terminating at rectangular shoulders 46 and 47 adapted to abut comparable shoulders on the main frame plate 6. The tines 43 and 44 are shaped to fit slidably but very snugly between the ledges 14 and 16 and between the side plates 17 and 18.

The tang 42 is internally configured between the tines 43 and 44 by a keyhole opening 45 having a smaller open end defined by interior walls 48 and 49 extending in the predetermined direction and by an adjoining and connected enlarged circular opening 51. The dimensions are such that the opening 51 is slightly larger in diameter than the circular portion 26 of the pin whereas the walls 48 and 49 are spaced apart only slightly more than the flat or chordal portion 27 of the lesser dimension portion of the pin. In addition, the socket 8 is also partially occupied by a steady pin 52 extending between the side plates 17 and 18 parallel to and adjacent the pin 24.

With this arrangement, when the pin 24 is displaced axially from the position shown in FIG. 4 into the position shown in FIG. 5 by manual pressure in the direction of the arrow 53 (FIG. 5), then the spring 37 is collapsed and the circular portion 26 of the pin is moved away from the interior of the structure and the non-circular portion or flats 27 are lined up generally with the interior of the blade 41 between the side plates 17 and 18. If the blade 41 has theretofore been separate, the blade can be brought into position and inserted into the socket 8 with the tines 43 and 44 on opposite sides of the flat portion 27 of the pin 24 and on the opposite sides of the pin 52. The opening 45 is aligned with the pin portion 26. At that stage there is a tight fit between all of the surrounding walls of the main frame with respect to the knife tang 42. Thereupon, pressure is relieved from the head 32; and the spring 37 is effective to move the pin axially until such time as the circular portion 26 advances into the circular portion 51 of the keyhole opening, making a relatively tight fit therewith. Under these circumstances, the knife blade is anchored very firmly in the handle, and the assembly can be utilized for severe service in the manner of an integral knife.

The blade can be removed by again pressing on the head 32 in the direction of the arrow 53, thus removing the portion 26 from the opening 45 and lining up, or axially shifting, the flat surfaces 27 so that the walls 48 and 49 can slide thereover in the predetermined direction as the blade tang 42 is withdrawn from the socket 8.

In some instances, as shown in FIG. 3, the interengagement of the parts is sufficiently firm and precise as to permit the elimination of the steady pin 52 and some shortening of the associated parts of the knife accordingly. By comparing FIGS. 1 and 3, it can be seen how the knife appears when assembled and when the blade is withdrawn.

Figures 6, 7, 8, 9:
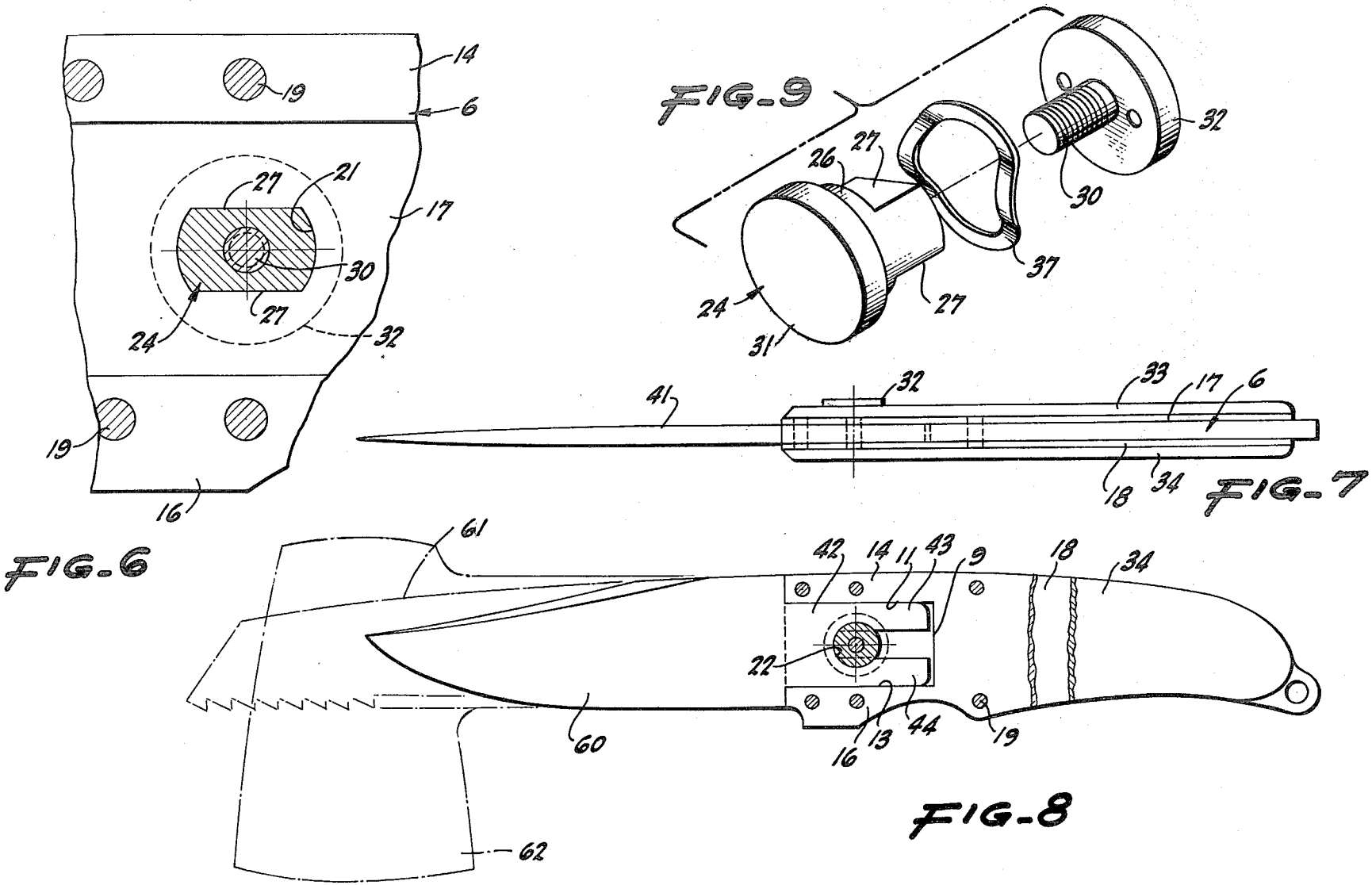
FIG. 6 is an enlarged detail in cross-section of a portion of one of the main frame side plates, the section being on the line 6—6 of FIG. 5.
FIG. 7 is an exploded, isometric view of the pin structure.
FIG. 8 is a side elevation of the knife of FIG. 7, certain portions being broken away.
FIG. 9 is a plan of the modified form of knife shown in FIG. 8.

As illustrated in FIG. 8, corresponding to the shortened version of FIG. 3 and which appears in plan substantially as shown in FIG. 9, it is feasible, after the blade 60 has been removed, by appropriate manipulation of the button head 32, to provide other implements such as a saw blade 61 or a hatchet blade 62. These are adequate for small work and are interchanged with knife blades 60, as required.

Figure 11:
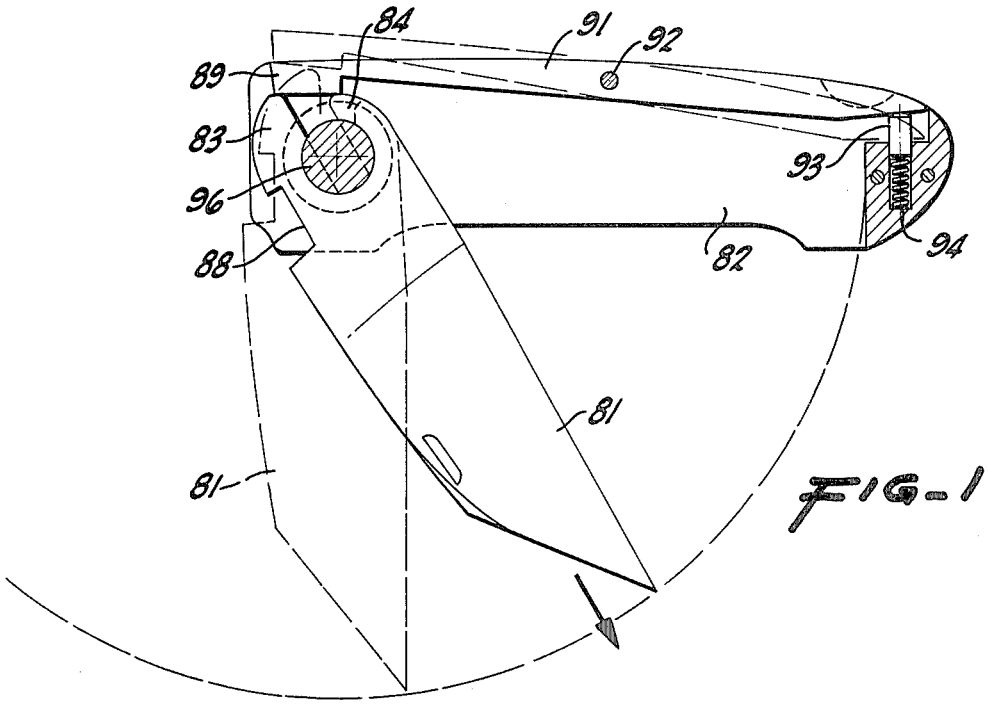
FIG. 11 is a view similar to FIG. 10 but showing the knife in partly folded position.
Figure 14:
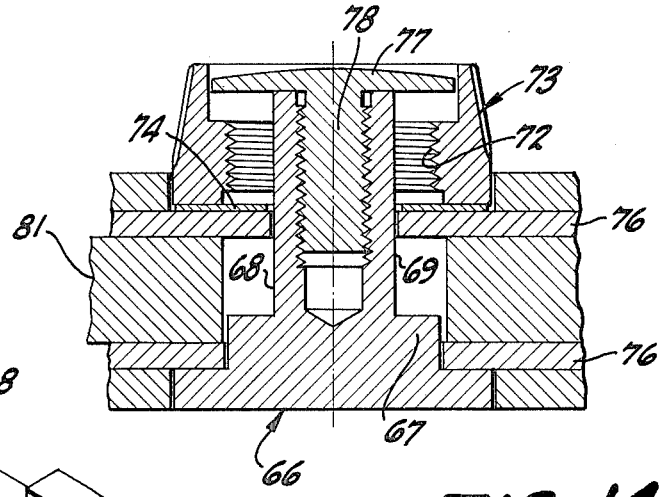
FIG. 14 is a cross-section comparable to FIGS. 12 and 13 showing the pin structure in a locking position.
Figure 16:
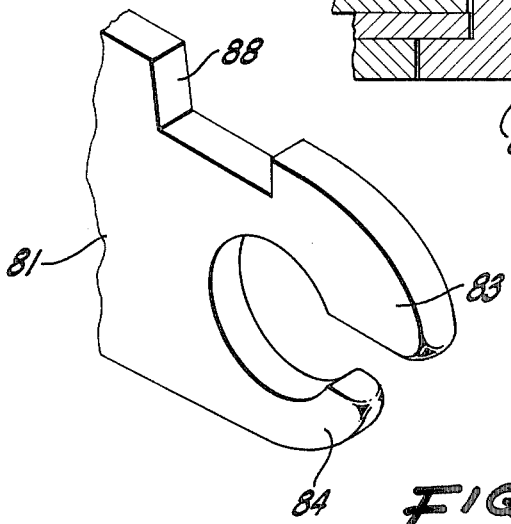
FIG. 16 is an isometric view showing an end portion of the blade utilized in FIGS. 10 and 11.

In the versions of the device described, the blade, although linearly removable, is not at anytime rotatable with respect to the main frame or the handle. In some instances, such rotation is desired. In that case an arrangement as shown in FIGS. 10 and 11; and 17–19 can be employed. In this instance the parts generally are as before described, but there is provided a different form of pin structure 66. The pin still has a large circular surface 67 (see FIGS. 12, 13 and 14) and a small diameter pair of chordal surfaces 68 and 69. In this instance the circular periphery of the pin between the chord flats 68 and 69 has a number of interrupted external threads 71 (FIG. 15). The external threads fit into internal threads 72 within a ring 73, preferably knurled around the outside. The ring rests coaxially with the pin and bears against a ripple spring 74 adjacent one of the side plates 76.

With this arrangement the ring 73 is first threaded upon the external threads 71 of the pin. Then a keeper bolt 77 having an externally threaded stem 78 is threaded into an internally threaded core 79 in the pin. The pin 66 is normally freely movable axially (FIGS. 12 and 13) under the pressure of manual contact and of the spring 74. When the keeper ring 73 is firmly advanced against the handle assembly (FIG. 14), the pin 66 is properly confined against a limited amount of axial motion.

In some instances it is desired to arrange the structure so that the pin cannot be moved transversely. If so, it is merely necessary to move the ring by rotating it manually toward the other end of the pin to urge the ring against the flattened spring 74 and then to continue until the head of the pin 66 is brought into the position shown in FIG. 14. The pin cannot then be translated transversely, and the parts are locked together and the blade cannot be released.

In the form of device shown in FIGS. 10 and 11, the operation is generally as described in connection with the other forms; and there is a special attribute in that the blade 81 not only is detachable from the main frame 82 but is likewise rotatable with regard thereto. In this arrangement the tines 83 and 84 are of dissimilar length and shape but are concentric with the axis 86 of the pin. The blade also differs from the previous arrangement in that it has a locking notch 88 in its periphery.

Designed to interengage with the notch is a pad or key 89 on the end of a lever 91 of springy material mounted on a fulcrum pin 92 spanning the side plates of the frame and movable in a clockwise direction against the action of a pin 93 urged by a spring 94. The lever 91 forms part of the sidewall of the socket 8 of the handle assembly. This arrangement keeps the pad 89 normally in the notch 88, and the blade can neither be removed nor rotated. However, when the lever 91 is rocked clockwise the pad 89 is moved out of the notch. With release of the through pin 96 the blade can be taken off directly as before. If the blade is not to be removed but is simply to be rotated, the same action of the lever takes place; but instead of then actuating the through pin, the blade is simply rotated about the axis. The arrangement is such, as particularly shown in FIG. 11, that at a convenient point the pad 89 rests on the ends of the inequal length tines 83 and 84 and in effect indexes or locates the blade at a particular approved angle. The blade can then be removed by first depressing the pin 96 and effecting withdrawal motion at the established angle corresponding to the angle of the specially oriented flat sides of the pin.

In another version, as shown in FIGS. 17, 18 and 19, the arrangement is very much like that of FIG. 10; but the lever 91 is partly replaced by a leaf spring 101 serving to index both on the face 102 of a flat indentation in the blade 103 and also against the generally symmetrical ends of the tines 104 and 106. In this instance the blade is releasable in the usual direction by moving the cross pin 107, as before, and is also rotatable when a lateral locking lever 109 is depressed. The lever 109 rocks around a pin 111 extending at right angles to the axis of the pin 107. The end of the lever carries a plate 112 designed to interfit between the tines when the blade is extended. To rotate the blade without removal, the lever 109 is depressed freeing the plate 112 from between the tines and then exerting a suitable rotational force on the blade.

What is claimed is:

1. A knife comprising a removable blade having a tip at one end and having a tang with substantially parallel sides at the other end;

means in said tang between said sides defining a keyhole-shaped slot having parallel walls extending inwardly from said other end of the blade toward the tip and merging with an enlarged circular opening in said tang between said sides;

a handle assembly;

means in said handle assembly including side plates defining a longitudinal socket between them and adapted to receive the tang sides in close fitting relationship;

means in one of said side plates defining a circular opening into one side of said socket;

means in the other of said side plates defining an oppositely located, non-circular aperture opening into the other side of said socket;

a generally circular-cylindrical blade-locking pin extending through said aperture, socket and opening, and having axial movement therein between transverse extreme positions;

heads at opposite ends of said pin adapted to abut said side plates thereby limiting said transverse movement;

said pin for a part only of its length having a non-circular portion between opposite flats, the dimension across said flats establishing slidable engagement of said flats with the parallel walls of the keyhole slot in the tang, and the diameter of the cylindrical portion of the pin corresponding substantially with the diameter of said tang circular opening;

the free length of the flats along the pin when the pin is at one of said extreme positions corresponding at least to the width between the tang sides at the keyhole-shaped slot, the circular-cylindrical portion of the pin projecting into the socket when the pin is at the other of said extreme positions;

means for biasing the pin into a position with said circular-cylindrical portion thereof in said circular opening of said tang for preventing longitudinal movement of the blade away from the socket except when said pin is axially moved against said biasing means to permit said flats to slide between said parallel sides of said keyhole slot;

and lock means movable into and out of a position for positively preventing axial movement of said pin.

2. A knife according to claim 1, said socket including a side plate including a pad movable relative to said side plate and into and out of engagement with said blade and said socket and said handle assembly being open in one direction for blade rotation about said pin for permitting rotation of said blade tang about said pin, said pin flats being angularly disposed in the socket relative to the longitudinal axis thereof whereby the blade tang must be rotated relative to the socket longitudinal axis to permit the keyhole slot flats to clear the angularly disposed parallel walls of the pin when the locking pin is axially moved into displaced position.

3. A knife according to claim 2, said tang having a locking notch therein and said handle assembly including a movable pad engageable with the notch for preventing rotation of the blade to align the parallel sides of the keyhole slot with the flats of the pin.

4. A knife according to claim 3, said pad being resiliently biased against the tang, the tang having a cam portion shaped to cooperate with said pad to permit smooth rotation of the blade about the pin while the cam portion and pad are slidably engaged, said cam portion including a locating detent cooperating with a portion of said pad for indexing the blade at its rotated position where separation of the blade from the handle assembly can be effected.

* * * * *